US005423675A

United States Patent [19]

Kratsch

[11] Patent Number: 5,423,675

[45] Date of Patent: Jun. 13, 1995

[54] BURNER MIXING CHAMBER

[76] Inventor: Kenneth Kratsch, San Clemente, Calif. 92672

[21] Appl. No.: 148,850

[22] Filed: Nov. 8, 1993

[51] Int. Cl.[6] ..... F23D 14/12

[52] U.S. Cl. ..... 431/328; 431/354; 48/180.1

[58] Field of Search ..... 431/328, 329, 354; 48/180.1

[56] References Cited

U.S. PATENT DOCUMENTS 3,199,571 8/1965 Koppel ..... 431/328
4,396,372 8/1983 Matumoto et al. ..... 431/354

FOREIGN PATENT DOCUMENTS 62797 3/1982 European Pat. Off. ..... 431/328
86509 5/1986 Japan ..... 431/329

*Primary Examiner*—Carroll B. Dority
*Attorney, Agent, or Firm*—James E. Brunton

[57] ABSTRACT

An apparatus for controllably mixing air with a combustible gas to form a combustible mixture. The apparatus includes a housing having an internal gas mixing chamber in communication with an elongated narrow gas inlet throat which is formed by a pair of converging, smoothly curved walls. A gas injector manifold is disposed proximate the gas inlet throat and is arranged so that air flows around and about the injector as it is drawn into the inlet throat either by a fan or through aspiration. Due to the novel aerodynamic shape of the walls which form the gas inlet throat, the combustible gas is thoroughly and efficiently mixed with the air to produce a combustible mixture that burns efficiently with a minimum of harmful emissions being produced.

19 Claims, 3 Drawing Sheets

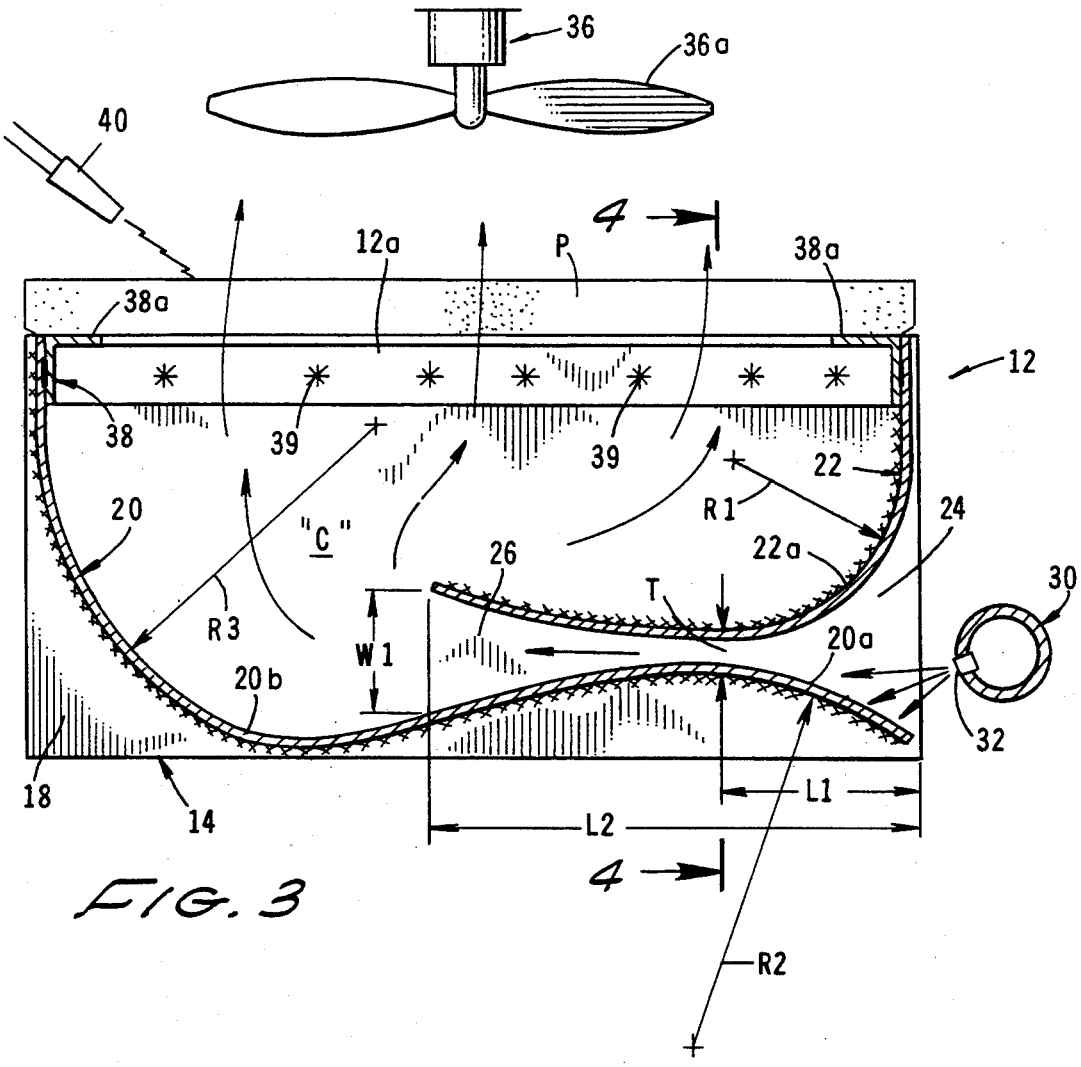
FIG. 3
FIG. 4
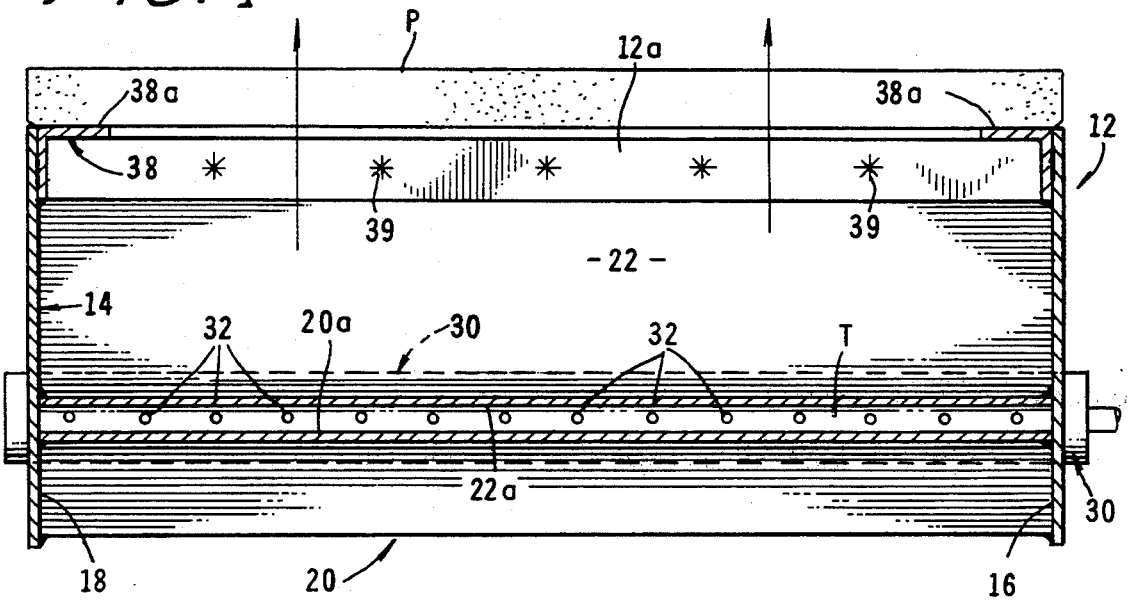

BURNER MIXING CHAMBER

BACKGROUND OF THE INVENTION

1. Field of the Invention

The present invention relates generally to mixing chambers for mixing gases. More particularly, the invention concerns a burner mixing chamber for mixing air and a combustible gas to form a combustible mixture.

2. Discussion of the Invention

In the past a number of approaches to the mixing of air and combustible gases such as natural gas and propane have been suggested. These include the use of cast iron burners, perforated, ribbed metal burners and numerous variations of the Venturi principle to supply an air-gas mixture for combustion.

A common prior art burner design involves the use of perforated, ribbed metal burners which are provided with a number of small venturi orifices, each having a single nozzle with an orifice to supply the combustible mixture. For typical heating requirements several burner units, each with a ribbed or slotted metal burner surface, are assembled together and held in position by various mechanical expedients. Spacing between the venturi orifices permits secondary air to be supplied to the flame for good combustion. Typical secondary air flow is on the order of 0 to 25 percent of the total air supply flowing to the inlet of the venturi orifices. A major drawback of these types of prior art burners is that, because of relatively inefficient combustion, they produce high levels of undesirable emissions such as carbon monoxide and nitrous oxides.

Another common prior art burner design which is based on the venturi principle, involves the inspiration of air into the venturi inlet of a single or double venturi by the flow of a higher pressure gas in a manner to create a negative absolute pressure at the entrance of the venturi inlet. Typically, a separate the venturi is placed into a metal chamber over which the burner material is superimposed with the air-gas mixture being ignited at the burner surface. In this type of design, the pressure drop experienced across the burner surface generally prevents good quality combustion due to insufficient inspiration of air and relatively high emission levels are common. In negative absolute pressure applications, this latter type of burner design is less than desirable and a reasonable flame stability is most difficult to achieve.

The burner mixing chamber of the present invention overcomes many of the drawbacks of the prior art systems by providing a mixing chamber of unique configuration that enables precise mixing of the input gas and sufficient air to produce a gas mixture that burns efficiently with surprisingly low emission levels. As will be better understood from the description which follows, in the apparatus of the present invention the inspirator is an integral part of the burner mixing chamber and the apparatus does not rely on secondary air to enhance combustion. The apparatus includes a combustion chamber of novel design that eliminates the costly spun metal, three dimensional venturi designs typically found in prior art systems and combustion at the burner surface is extremely stable with air in excess of stoichiometric air-gas ratios being readily attained. Large variations in excess air, for example, 10 to 100 percent, are possible without sacrificing combustion stability. Similarly, variations in gas flow due to pressure changes, gas heating value and like effects are readily accommodated and high quality combustion with very low carbon monoxide and nitrous oxide emissions is consistently achieved.

SUMMARY OF THE INVENTION

It is an object of the present invention to provide a burner mixing chamber of unique design which precisely mixes gas and air to produce a combustible mixture that burns efficiently with minimum emission levels.

Another object of the invention is to provide a device of the aforementioned character which can readily be used with hot water heaters, kitchen cook tops and commercial cooking units as well as with a variety of other types of apparatus used for space heating, heat treatment and for the drying of numerous types of manufactured goods.

Another object of the invention is to provide a device of the character described in which stable combustion at the burner surface is routinely achieved and air in excess of stoichiometric air-gas ratios is readily attained.

Another object of the invention is to provide burner mixing chamber of the class described in the preceding paragraphs in which large variations in excess air are possible without sacrificing combustion stability.

Another object of the invention is to provide a burner mixing chamber that operates efficiently with a carbon dioxide content in the flue gases of between 6.5 and 10.5 percent.

Still another object of the invention is to provide a burner mixing chamber which is of simple design, is reliable and one which can be easily and inexpensively manufactured.

A major object of the invention is to provide a burner mixing chamber in which the inspirator is an integral part and one which can operate with both fan powered induced air flow by pushing air (positive pressure) or by pulling air (negative pressure) as well as by natural aspiration to provide air for full combustion without the need for secondary air.

BRIEF DESCRIPTION OF THE DRAWINGS

FIG. 3 is a cross-sectional view taken along lines 3—3 of FIG. 2.

FIG. 4 is a cross-sectional view taken along lines 4—4 of FIG. 3.

DESCRIPTION OF THE INVENTION

Figure 1:
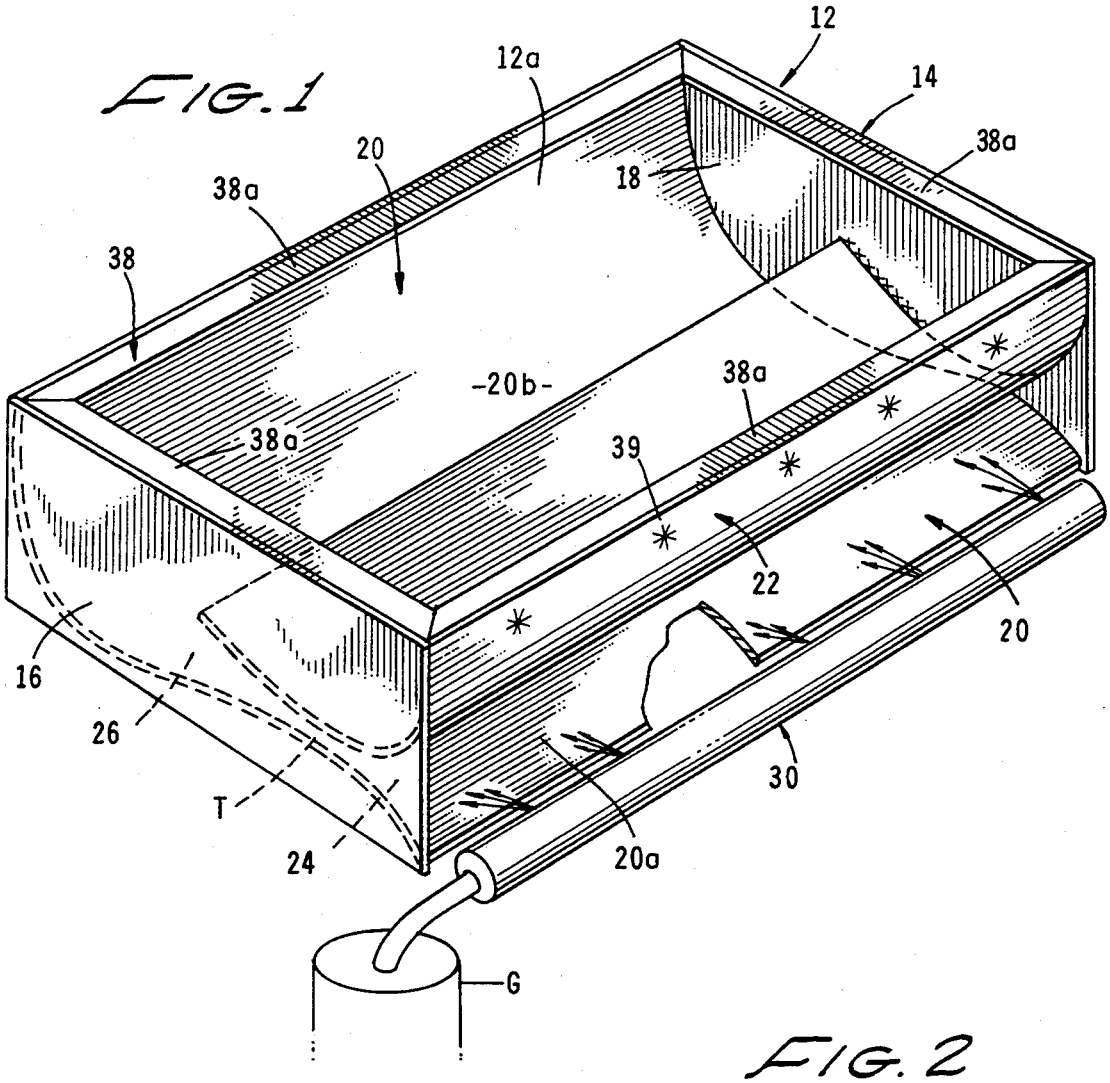
FIG. 1 is a generally perspective view of one form of the apparatus of the invention for mixing a combustible gas with air.
Figure 2:
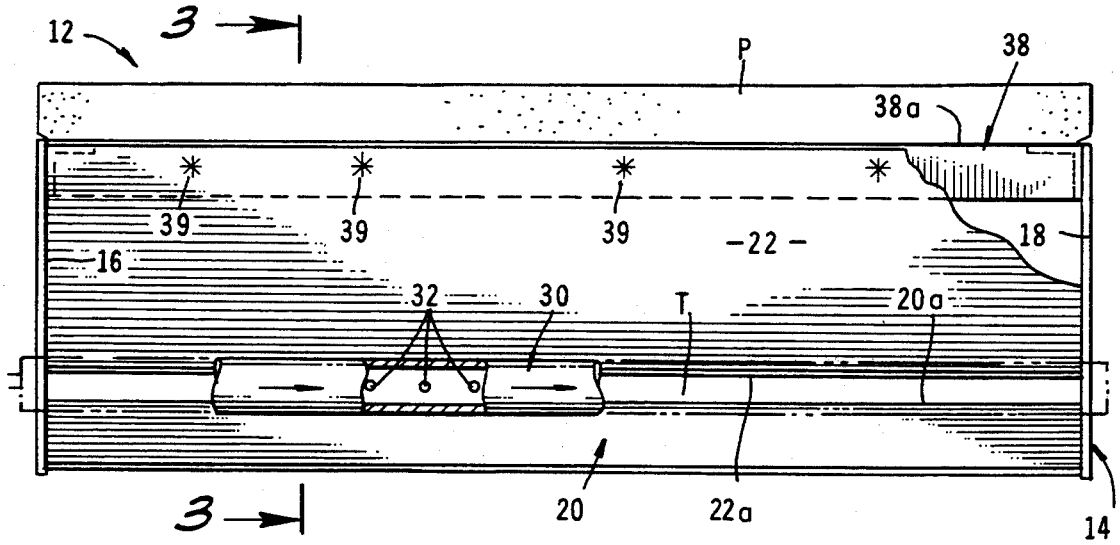
FIG. 2 is a front elevational view of the apparatus of FIG. 1 partly broken away to show internal construction.

Referring to the drawings and particularly to FIGS. 1, 2 and 3, one form of the apparatus of the present invention for mixing first and second gases such as air and a combustible gas is there shown and is generally designated by the numeral 12. The apparatus here comprises a sheet metal housing 14 having first and second transversely spaced apart side walls 16 and 18. A third, or bottom wall, 20 is connected to and extends between side walls 16 and 18. Wall 16 has a curved, generally convex first portion 20*a* which is smoothly joined with a curved, generally concave second portion 20*b* (FIG. 3). Walls 14, 16 and 20 cooperate to define an internal mixing chamber "C".

A fourth wall 22, which is of a length substantially less than the first length of bottom wall 20 is also connected to and extends between first and second walls 14 and 16. Fourth wall 22 has a generally convex, curved first portion 22*a* which converges toward and cooperates with curved first portion 20*a* of bottom wall 20 to define a long, narrow inlet throat "T". Throat "T" has inlet mouth 24, which is in communication with atmosphere, and an outlet mouth 26, which is in communication with chamber "C". As best seen by referring to FIG. 3, bottom wall 20 extends substantially the entire depth of housing 12 while curved wall 22 extends into the housing a shorter distance identified in FIG. 3 as L2. Curved wall 22 has a radius designated in FIG. 3 as R1, while the curved first portion 20*a* of wall 20 has a radius designated as R2. Wall 22 and first portion 20*a* of wall 20 smoothly converge toward one another to define the constricted passageway or throat "T" and then smoothly diverge from one another to define the outlet mouth 26 which has a width designated in FIG. 3 as W1.

Also forming a part of the apparatus of the invention depicted in the drawings is an injector means for directing the second or combustible gas inwardly of mouth 26 and toward inlet throat "T". The injector means is here provided in the form of an elongated manifold 30. As best seen by referring to FIG. 3, manifold 30 is mounted proximate inlet mouth 24 and, as shown in FIG. 4, extends substantially the length thereof. Manifold 30 is connected to a combustible gas source "G" (FIG. 1) and is provided with a multiplicity of jet-like apertures 32, which are arranged to direct the combustible gas outwardly of the tube in a direction so as to impinge upon curved portion 20*a* of wall 20 proximate inlet mouth 24.

In order to controllably draw the combustible gases from manifold 30 into chamber 3 and to simultaneously draw air from atmosphere through inlet mouth 24 and into chamber "C", there is provided suction means for drawing the gases into the chamber through the inlet throat. Referring to FIG. 3, the suction means is here provided in the form of a motorized exhaust fan 36 which is mounted above the open top 12*a* of chamber "C". Exhaust fan unit 36 is of standard construction and is readily commercially available. When energized, the blades 36a of the fan cause air flow inwardly of inlet mouth 24, through throat "T", into chamber "C", and outwardly of the housing through opening 12*a* in the manner illustrated by the arrows in FIG. 3. In operation fan 36 controllably draws both air from atmosphere as well as the combustible gas flowing from outlet jets 32 smoothly into inlet mouth 24 at a rate sufficient to cause the gases to flow rapidly through throat "T" where they are mixed together and then expanded into chamber 3 through outlet mouth 26. Because of the novel aerodynamic design of the apparatus, as the gases flow through throat "T" and outwardly through outlet mouth 26, they are thoroughly and completely mixed together in proportions determined by the volume of gas flowing through manifold 30,and through inlet mouth 24.

As indicated in FIG. 3, after the first and second gases, in this instance air and a combustible gas such as natural gas or propane, are completely intermixed, the gas mixture is urged smoothly upwardly through opening 12*a*. As shown in FIG. 3, a burner plate "P" is sealably emplaced over chamber opening 12*a* and is securely held in position by a rectangular frame 38, which circumscribes opening 12*a*. Frame 38 includes an upper surface 38*a* upon which burner plate "P" rests. As indicated in FIG. 2, frame 38 can be held in position within housing 12 by spot welding at spaced-apart locations generally designated in FIG. 2 by the numeral 39.

Burner plate "P" can be constructed from various types of porous burner material such as ceramic fibers, ported ceramic, or metal fibers which are contained within an appropriate framework of a character that can be readily fitted over surface 38*a* of frame 38. A burner plate assembly well suited for use in connection with the present apparatus is a gas radiant burner plate manufactured and sold by Global Environmental Solutions of San Clemente, Calif. This burner plate can be specially configured to provide a specific pressure drop across the burner plate, depending on the application and desired performance characteristics desired. These burner plates are constructed from a multiplicity of interconnected ceramic fibers which are coated with a silicon carbide by a chemical vapor infiltration process.

In order to ignite the air-gas mixture flowing through chamber "C" ignition means are provided In the embodiment of the invention shown in FIG. 3, the ignition means comprises an electric spark igniter 40 of a character well known in the art and of a type which is readily commercially available. Igniter 40 functions to produce a spark proximate the surface of burner "P" which ignites the combustible gas mixture flowing through opening 12*a*.

Because of the combustible mixture produced in the apparatus of the present invention is air rich with excess air typically on the order of 10 to 100 percent greater than required stoichiometric values, the carbon monoxide and nitrous oxide emissions flowing from the apparatus are extremely low.

It is to be understood that the burner chamber may be round, rectangular or any other geometric shape best suited for the intended purpose of providing heat to a receptor. The single burner chamber may be small (several inches in size) or it can be very large (several feet in size) depending upon its domestic or commercial appliance application. By way of specific example, in the form of the apparatus illustrated in the drawings, the housing is approximately seven inches deep and approximately 11 inches long. The maximum depth of chamber "C" is approximately three inches while the width of throat "T" is on the order of one-quarter of an inch. The length of wall 22 which is designated in FIG. 3 as L2, is preferably on the order of three and three-quarters inches, while the distance between the front wall and the center of throat "T" (identified in FIG. 3 by L1) is on the order of one inch. Similarly, in the form of the invention shown in FIG. 3, the radius R1 of convex wall 22 is approximately equal to one and three-quarter inches while the radius R2 of portion 20*a* of wall 20 is on the order of three inches. The radius R−3 of portion 20*b* of wall 20 is preferably on the order of two and one-half inches. For optimum performance of this particular unit, the width w1 of outlet mouth 26 is on the order of one inch. Once again it is to be understood that the physical dimensions of the apparatus of the invention can vary markedly depending upon the end use to be made of the apparatus. For example, the chamber of the invention can be of a size convenient for use in connection with hot water heaters and boilers, it can be used in connection with cook tops and appliances of various sizes. Similarly the chamber can be sized for use in connection with very large industrial heating and drying equipment as well as for space heating.

Figure 5:
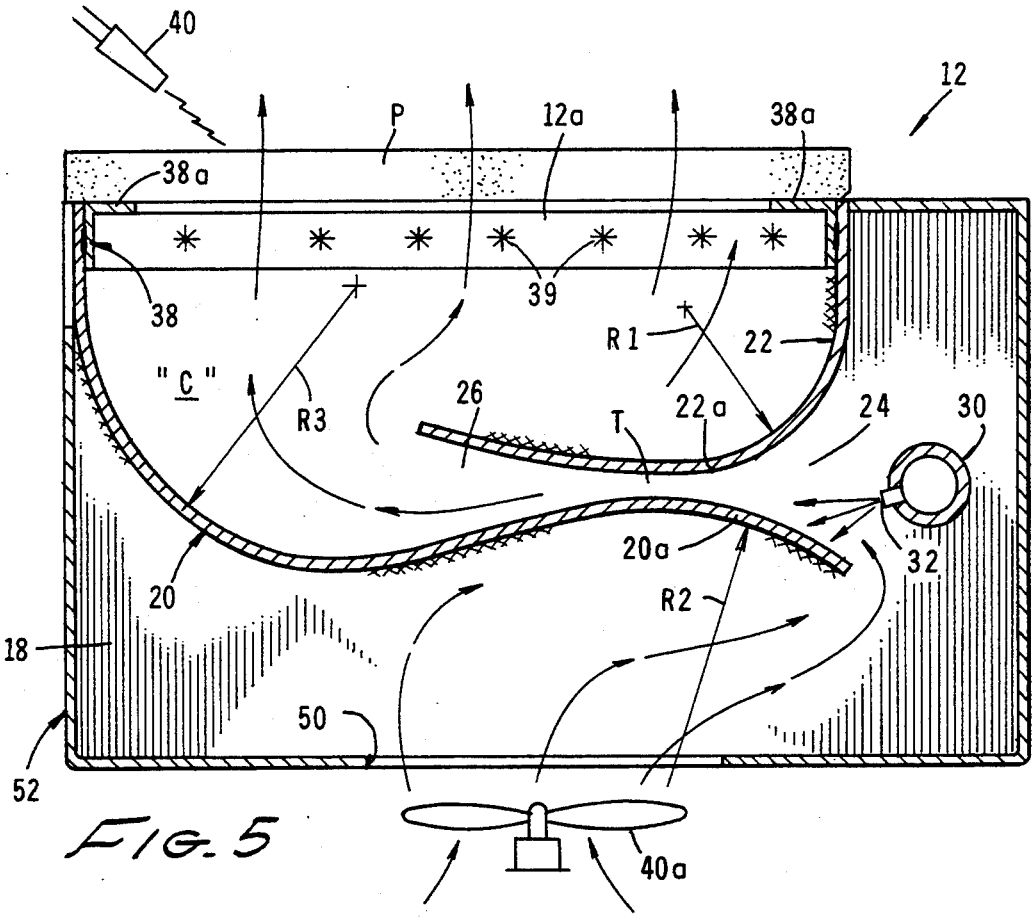
FIG. 5 is a cross-sectional view of an alternate form of the invention.

Referring to FIG. 5, an alternate form of the apparatus is there shown. This form of the apparatus is similar in most respects to the apparatus shown in FIG. 3 and like numbers are used to designate like components. The principal difference between the apparatus shown in FIG. 5 and that previously described resides in the fact that, instead of the air being drawn in from atmosphere by the fan 40 which is superimposed over burner plate "P" the air is "pushed" in through an opening 50 provided in the bottom of a housing 52 that surrounds walls 20 and 22. A conventional fan **40*a* is provided for this purpose and is mounted below housing 52 in the manner shown in FIG. 5. With this construction, as shown by the arrows in FIG. 5, fan 40*a* forces air through opening 52, past wall 20, into mouth 24 and through throat "T". As before the gas emanating from manifold 30 completely mixes with the air as the gases flow through throat "T" and into chamber "C" via mouth 26. The gas mixture then flows through burner plate "P" where it is ignited by igniter 40**.

Figure 6:
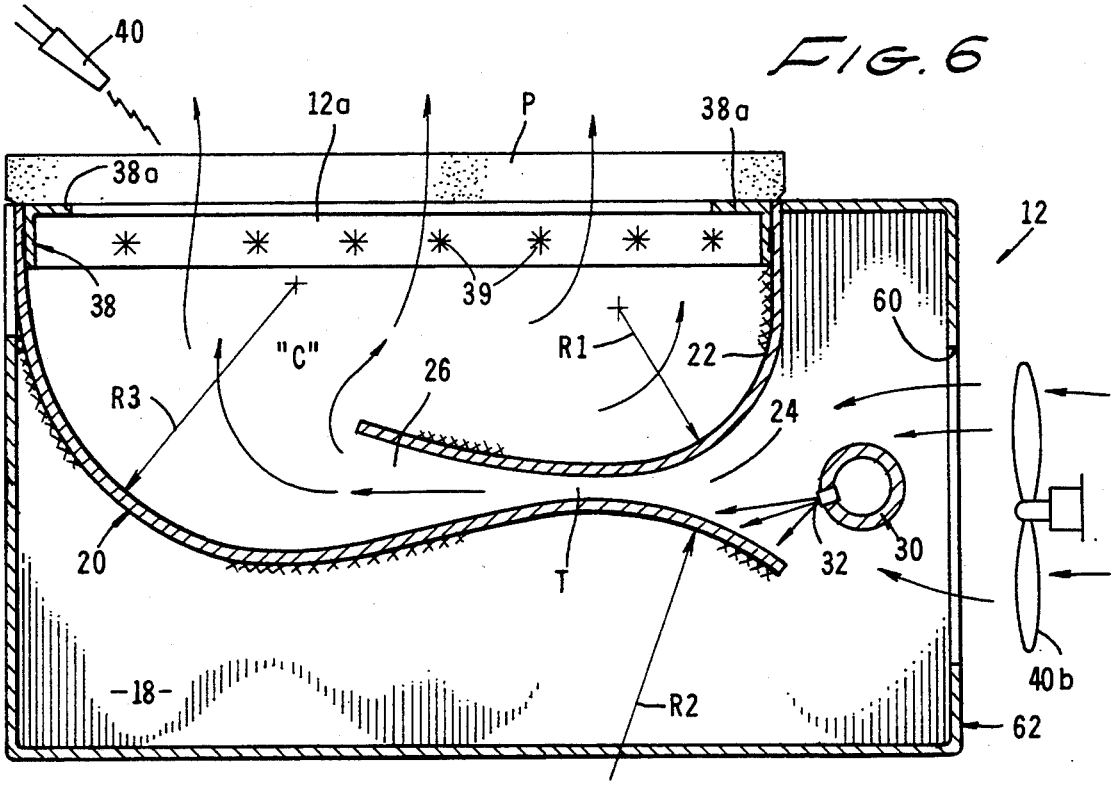
FIG. 6 is a cross-sectional view of still another alternate form of the invention.

Turning now to FIG. 6, still another alternate form of the apparatus is there shown. This form of the apparatus is also similar in most respects to the apparatus shown in FIG. 3 and like numerals are used to designate like components. The principal difference between the apparatus shown in FIG. 6 and that previously described resides in the fact that air is "pushed" in through an opening 60 provided in the front of a housing 62 that surrounds walls 20 and 22. A conventional fan **40*b* is provided for this purpose and is mounted in front of housing 62 in the manner shown in FIG. 6. With this construction, as shown by the arrows of FIG. 6, fan 40*b* forces air through opening 62, past manifold 30, into mouth 24 and through throat "T". As before the gas emanating from manifold 30 is completely mixed with the air as the gases flow through throat "T" and into chamber "C" via mouth 26. As the gas mixture then flows through burner plate "P" where it is ignited by igniter 40** in the manner previously described.

In some applications, no fan of any kind is required and the air is aspirated into mouth 24 from atmosphere as a result of the gases flowing into mouth 24 from manifold 30. In such instances the pressure of the gas flowing through manifold 30 is sufficient to pull air into the unit without the use of either a "push" or "pull" fan being required.

As previously mentioned, as a result of the thorough and complete mixing of the gases as they flow through the apparatus of the invention, harmful emission levels are quite low. For example, typical emissions for both carbon monoxide and nitrous oxide are generally below 20 to 30 parts per million.

The long, narrow inlet throat and the inlet mouth 24 provide a novel aerodynamic surface which substantially enhances smooth, air flow into chamber "C" and the inlet radiuses R1 and R2 and the width of throat "T" can be precisely sized for the particular burner energy load required. Similarly, distances L1 and L2 can be specifically tailored to mixing and uniform distribution of the air-gas mixture over the burner material under surface. The burner material or burner plate is preferably sealed at the top of the mixing chamber by interconnecting the burner plate with the upper surfaces **38*a* of frame member 38** by any suitable bonding means such as a high temperature adhesive.

The size and number of orifices or jets 32 provided in manifold 30 determine the energy load and are strategically positioned relative to inlet throat 24 so as to optimize mixing of the gases. Further, the injector means can take various forms other than the tubular manifold unit shown in the drawings. For example, the injection means can comprise an elongated conduit which is triangular in cross-section or any other desired configuration that may be required for proper injection of the combustible gas into the throat of the unit. Similarly, the jets 32 can be circular or rectangular and can be directed to impinge on the lower aerodynamic surface **20*a* at selected locations so as to optimize gas mixing. Because the air is drawn from atmosphere into inlet mouth 24, both above and below injection tube 30** and is then expanded into the burner mixing chamber "C", ideal mixing and uniform distribution of the combustion mixture results.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for mixing first and second gases comprising a housing having spaced apart side walls and including:

(a) a pair of curved walls forming, in conjunction with the side Walls, a chamber, each of said curved walls having a curved first portion said curved first portions of said walls converging toward one another to define an elongated gas inlet throat in communication with said chamber and in communication with the first gas;

(b) injector means for directing the second gas inwardly of said inlet throat; and (c) means for drawing the first and second gases into said chamber through said throat.

2. An apparatus as defined in claim 1 in which said injector means comprises an elongated tube having a plurality of spaced-apart apertures, said tube being in communication with the second gas and being disposed proximate said inlet throat.

3. An apparatus as defined in claim 1 in which said chamber has an opening and in which said means for drawing the first and second gases into said chamber comprises a motorized exhaust fan superimposed over said opening.

4. An apparatus as defined in claim 3 further including a burner element superimposed over said opening in said chamber.

5. An apparatus as defined in claim 4 further including igniter means for igniting the mixture of first and second gases.

6. An apparatus for mixing first and second gases comprising:

(a) a housing including:

(i) spaced-apart first and second walls;

(ii) a third wall connected to and extending between said first and second walls, said third wall having a curved first portion and a second portion and cooperating with said first and second walls to define a chamber;

(iii) a fourth wall connected to and extending between said first and second walls, said fourth wall having a curved first portion extending toward and cooperating with said curved first portion of said third wall to define an elongated inlet throat in communication with the first gas and with said chamber;

(b) injector means for directing the second gas toward said inlet throat; and (c) means for drawing the first and second gases into said chamber through said inlet throat.

7. An apparatus as defined in claim 6 in which said means for drawing the first and second gases into said chamber comprises an exhaust fan disposed proximate said chamber.

8. An apparatus as defined in claim 7 in which said second gas is combustible and in which said apparatus further includes igniter means for igniting mixture of the first and second gases.

9. An apparatus as defined in claim 8 in which said third wall comprises the base wall of said chamber.

10. An apparatus as defined in claim 9 in which said fourth wall extends over said third wall and includes a second portion which diverges from said third wall to define an elongated outlet passageway of a first height.

11. An apparatus as defined in claim 10 in which said inlet throat is of a second height substantially less than said first height of said outlet passageway.

12. An apparatus for mixing a combustible gas with air comprising:

(a) a housing including:

(i) spaced apart first and second walls;

(ii) a third wall of a first length connected to and extending between said first and second walls, said third wall having a curved, generally convex first portion and a curved generally concave second portion and cooperating with said first and second walls to define a chamber;

(iii) a fourth wall of second length substantially less than said first length connected to and extending between said first and second walls, said fourth wall having a generally convex curved first portion extending toward and cooperating with said curved first portion of said third wall to define an elongated inlet throat having an inlet mouth in communication with atmosphere and an outlet mouth in communication with said chamber;

(b) injector means for directing the combustible gas toward said inlet throat, said injector means comprising an elongated, perforated manifold in communication with the combustible gas and extending substantially the extent of said inlet mouth; and (c) means for urging the first and second gases into said chamber through said inlet throat.

13. An apparatus as defined in claim 12 in which said means for urging the first and second gases into said chamber comprises an exhaust fan superimposed over said chamber.

14. An apparatus as defined in claim 12 in which said means for urging the first and second gases comprises a fan adapted to blow air past said injector means in a direction toward said inlet throat

15. An apparatus as defined in claim 12 in which said perforated manifold of said injector means directs the combustible gas toward said first portion of said third wall at a location proximate said inlet throat.

16. An apparatus as defined in claim 12 further including igniter means for igniting the mixture of air and combustible gas.

17. An apparatus as defined in claim 16 in which said igniter means comprises an electrical sparking device.

18. An apparatus for mixing first and second gases comprising:

(a) a housing including:

(i) spaced-apart first and second walls;

(ii) a third wall connected to and extending between said first and second walls, said third wall having a curved first portion and a second portion and cooperating with said first and second walls to define a chamber;

(iii) a fourth wall connected to and extending between said first and second walls, said fourth wall having a curved first portion extending toward and cooperating with said curved first portion of said third wall to define an elongated inlet throat in communication with the first gas and with said chamber, said curved first portion of said third wall converging toward said curved first portion of said fourth wall to define said elongated throat;

(b) injector means for directing the second gas toward said inlet throat; and (c) means for drawing the first and second gases into said chamber through said inlet throat.

19. An apparatus as defined in claim 16 in which said injector means comprises an elongated manifold disposed proximate said elongated throat, said manifold being in communication with the second gas and having a plurality of spaced-apart outlet apertures.

* * * * *